US006638131B1

(12) United States Patent
Thai

(10) Patent No.: US 6,638,131 B1
(45) Date of Patent: Oct. 28, 2003

(54) NON-SPILL CONTAINER

(75) Inventor: Douglas Thai, Walnut, CA (US)

(73) Assignee: Arko Development Limited (HK)

( * ) Notice: Subject to any disclaimer, the term of this patent is extended or adjusted under 35 U.S.C. 154(b) by 0 days.

(21) Appl. No.: 09/696,986

(22) Filed: Oct. 26, 2000

Related U.S. Application Data

(63) Continuation-in-part of application No. 09/562,609, filed on May 1, 2000.

(51) Int. Cl.[7] ..... A63H 33/28; A63H 23/08

(52) U.S. Cl. ..... 446/15; 446/267

(58) Field of Search ..... 446/15, 16, 17, 446/18, 19, 20, 21, 22; 220/254, 256, 259, 803, 804, 267; 215/364

(56) References Cited

U.S. PATENT DOCUMENTS 3,579,898 A * 5/1971 Hein ..... 446/16
5,105,975 A 4/1992 Patterson
5,265,757 A * 11/1993 Wu ..... 220/707
5,273,172 A * 12/1993 Rossbach et al. ..... 215/229
5,361,934 A * 11/1994 Spence, Jr. ..... 215/388
5,465,866 A * 11/1995 Belcastro ..... 220/709
5,509,551 A * 4/1996 Terrell, II ..... 215/229
5,513,762 A * 5/1996 Janani ..... 215/229
5,579,948 A * 12/1996 Lin ..... 215/229
5,702,020 A * 12/1997 Larsen ..... 215/229
RE36,131 E 3/1999 Schramm
5,897,013 A * 4/1999 Manganiello ..... 215/229
6,132,125 A * 10/2000 Lin ..... 401/17
6,135,842 A * 10/2000 LaFata ..... 206/207
6,170,719 B1 * 1/2001 Wilkinson et al. ..... 215/235

* cited by examiner

*Primary Examiner*—Jacob K. Ackun
*Assistant Examiner*—Faye Francis
(74) *Attorney, Agent, or Firm*—Raymond Sun

(57) ABSTRACT

A container has a container body that has an inner chamber, a bottom wall, a top wall, a opening provided in the top wall, and a tube extending from the opening into the inner chamber to provide communication between the inner chamber and the exterior of the container body. The opening can be curved, the tube can have a curved cross-section, and the tube can be positioned offset from the center of the inner chamber.

19 Claims, 6 Drawing Sheets

NON-SPILL CONTAINER

RELATED CASES

This is a continuation-in-part of Ser. No. 09/562,609, entitled "Non-Spill Container", filed May 1, 2000, whose disclosures are incorporated by this reference as though fully set forth herein.

BACKGROUND OF THE INVENTION

1. Field of the Invention

The present invention relates to liquid containers, and in particular, to a non-spill container.

2. Description of the Related Art

Bubble producing toys and devices are very popular with children. A wide variety of such bubble producing toys are now available in the market. Despite this widespread variety, the most basic form of a bubble producing toy is a wand that has a handle at one end and a loop at a second end. The loop is dipped into a bubble solution (which is usually soap) so that a film of the bubble solution extends across the area of the loop. The child can then blow at the loop to create bubbles.

The use of this wand and its loop requires that the loop be continuously dipped into the bubble solution to create more bubbles. Therefore, the container for the bubble solution must provide sufficiently convenient access to the user for continuous dipping of the wand and its loop.

Another important characteristic that the bubble solution container must have is that it should guard against spills. Since most bubble solution is made from soap, spills can be very messy. A number of spill-proof or non-spill containers have been provided to guard against spills of liquids stored therein. An example of a non-spill container is illustrated in U.S. Pat. No. 5,105,975 to Patterson, which provides a top member that is releasably mounted to a bottom member. A tube extends through an opening in the top member. The volume of the bottom member is provided to be smaller than the volume of the top member so that the liquid contained in the bottom member is prevented from entering the tube when the container is tipped. Unfortunately, the container in U.S. Pat. No. 5,105,975 is not completely spill-proof, and leakage is still possible.

In light of the above, there still remains a need for a container that effectively prevents the liquid stored therein from being spilled.

SUMMARY OF THE INVENTION

It is therefore an object of the present invention to provide a container that effectively prevents the liquid stored therein from being spilled.

It is another object of the present invention to provide a container that provides convenient continuous access to the liquid stored therein.

The objects of the present invention may be achieved by providing a container having a container body that has an inner chamber, a bottom wall, a top wall, a opening provided in the top wall, and a tube extending from the opening into the inner chamber to provide communication between the inner chamber and the exterior of the container body.

In one embodiment, the opening can be curved.

In another embodiment, the tube can have a curved cross-section.

In yet another embodiment, the tube can be positioned offset from the center of the inner chamber.

The container body can include a cup-like lower body that receives liquid therein and has an open upper mouth. The container body can also include an inverted cup-like upper body having an open lower mouth. The upper body is removably connected to the lower body with the open mouths thereof in communication with each other to form the inner chamber. The container can also include a lid pivotably coupled to the top wall and covering the opening, and a stopper inserted through the opening.

Thus, the pivotable lid covers the opening, and retains the stopper securely in place so as to prevent liquid from exiting through the opening. The stopper can be easily and conveniently removed from the opening to allow the user with quick and convenient access to the liquid stored in the interior of the container.

DESCRIPTION OF THE PREFERRED EMBODIMENTS

Figure 2:
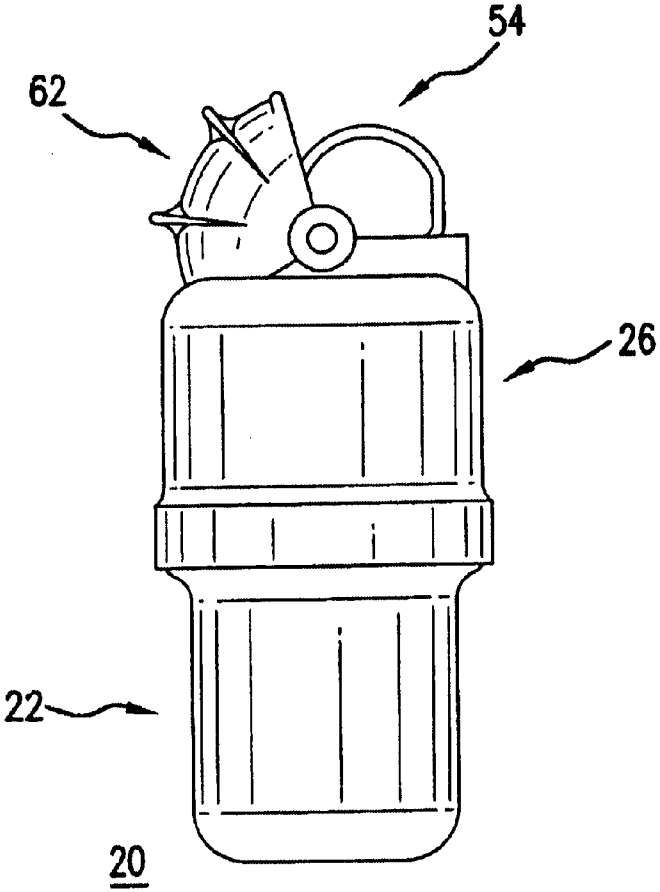
FIG. 2 is a side plan view of the container of FIG. 1 shown with the lid in the opened position.
Figure 1:
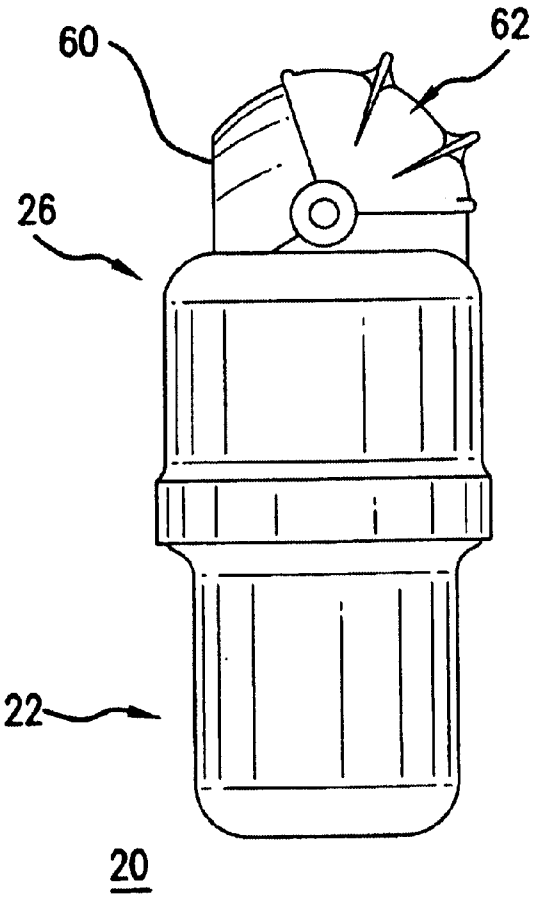
FIG. 1 is a side plan view of a non-spill container according to one embodiment of the present invention shown with the lid in the closed position.
Figure 5:
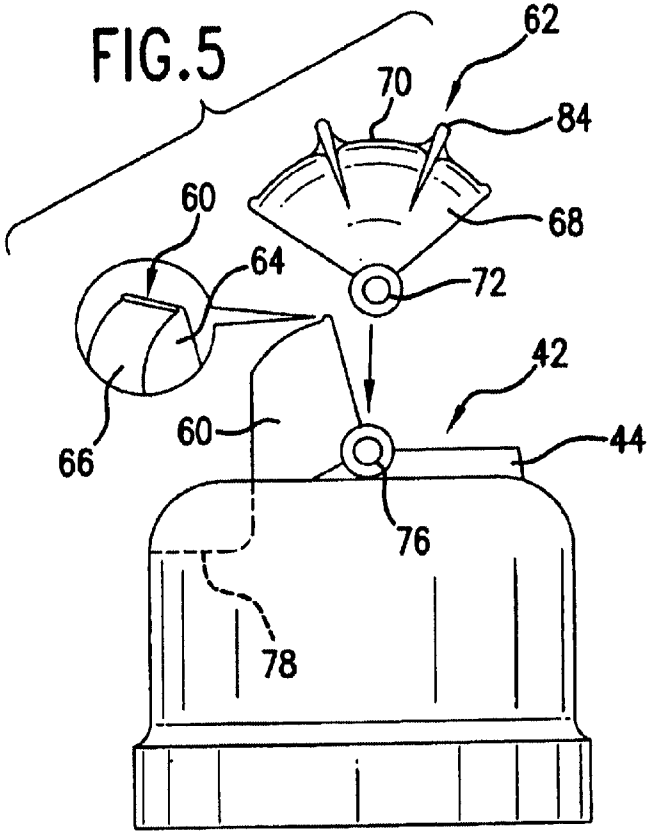
FIG. 5 is an enlarged exploded view of the lid of the container of FIGS. 1–4.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention is applicable to all containers that hold or otherwise retain liquid. Such containers can be used to hold any type of liquid, where the liquid needs to be dispensed using a wand, a tong, or other dispensing device.

Thus, the container can be used to hold bubble solution for use with a bubble producing toy, or it can be used to hold medicine, detergent or other liquids.

The present invention provides a non-spill container having an opening through which a stopper may be inserted. A pivotable lid is positioned over the opening to cover the opening, and to retain the stopper securely in place so as to prevent the liquid from exiting through the opening. The stopper can be easily and conveniently removed from the opening to allow the user with quick and convenient access to the liquid stored in the interior of the container.

FIGS. 1–7 illustrate one embodiment of a non-spill container 20 according to the present invention. The container 20 has a lower body 22 defining an interior chamber 24, and an upper body 26 that is removably connected to the lower body 22. The lower body 22 is cup-like in that it is generally cylindrical, has an open mouth and has a bottom wall 28. The top 30 of the lower body 22 has an upper annular flared rim 32 having external threads 34, with the upper flared rim 32 defining the open mouth. The upper body 26 is also generally cylindrical with an inverted cup-like configuration, and has a lower annular flared rim 36 that has internal threads 38. The lower flared rim 36 has a slightly larger diameter than the upper flared rim 32 so that the lower flared rim 32 of the lower body 22 can be received inside the upper flared rim 36 of the upper body 26. The upper body 26 also has a top wall 40, with an elongated opening 42 provided in the top wall 40. A border ridge 44 surrounds and defines a well region that includes the opening 42. The well region has a ledge 50 that is adapted to engage or receive an extension 52 of a stopper 54. The well region also has an angled inner surface 56 that is adapted to engage an angled lower edge 58 of the stopper 54. A hood 60 is provided above the top wall 40 and cooperates with a lid 62 to cover the well region. The hood 60 is also smaller than the lid 62 so as to act as a guide over which the lid 62 can be pivoted (see FIGS. 2 and 4). The hood 60 has two side walls 64 and a rounded top wall 66.

A lid 62 is pivotably secured to the border ridge 44. The lid 62 has two side walls 68 and a rounded top wall 70. Each side wall 68 has a rounded lower point 72. Pivot points 74 and 76 can be provided on opposite longitudinal edges of the ridge 44. A small bearing point (not shown) is provided between each pivot point 74 or 76 and the corresponding rounded lower point 72 to allow the points 72 of the lid 62 to pivot about these pivot points 74, 76 from a completely closed position, shown in FIGS. 1 and 3, in which the lid 62 combines with the hood 60 to completely enclose the well region and the stopper 54, to a completely opened position, shown in FIGS. 2 and 4, in which the lid 62 is seated over the top of the hood 60 to expose the stopper 54. The top of the ridge 44 defines a stop surface for the pivoting lid 62 in the closed position, and a groove 78 provided in the top wall 40 adjacent the hood 60 defines a stop surface for the pivoting lid 62 in the opened position. Ridges or bumps 84 can be provided on top of the lid 62 to facilitate gripping by the user.

Figure 4:
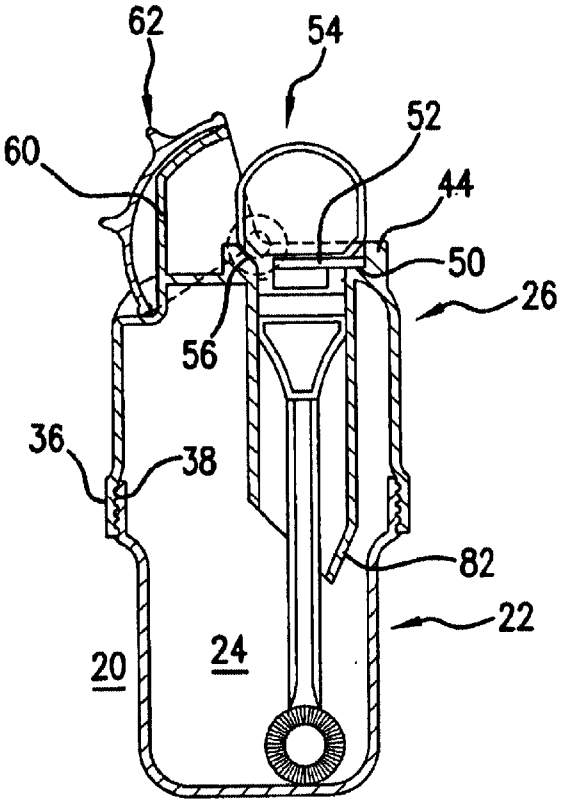
FIG. 4 is a cross-sectional view of the container of FIG. 2.
Figure 3:
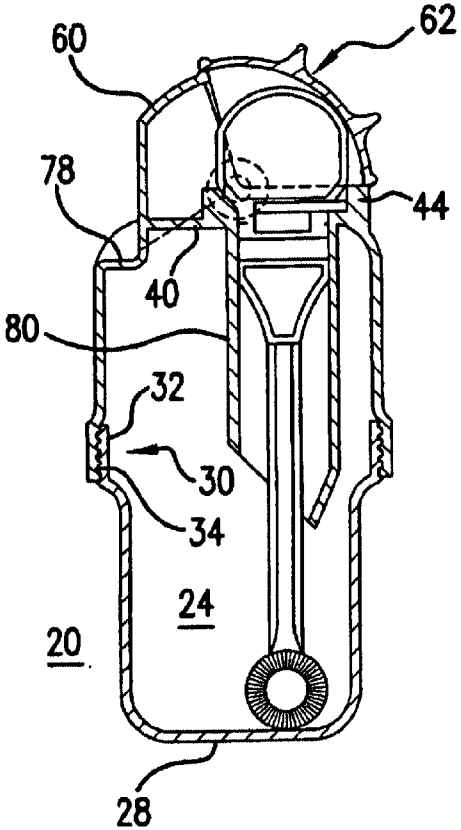
FIG. 3 is a cross-sectional view of the container of FIG. 1.
Figure 7:
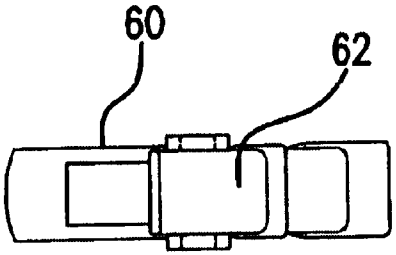
FIG. 7 is a top plan view of a portion of the container of FIGS. 1–4 with the lid covering the opening.
Figure 6:
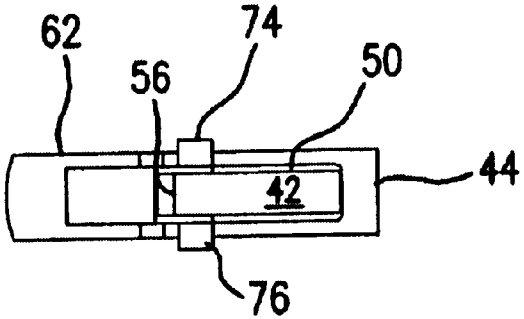
FIG. 6 is a top plan view of the opening of the container of FIGS. 1–4 with the lid opened.
Figure 14:
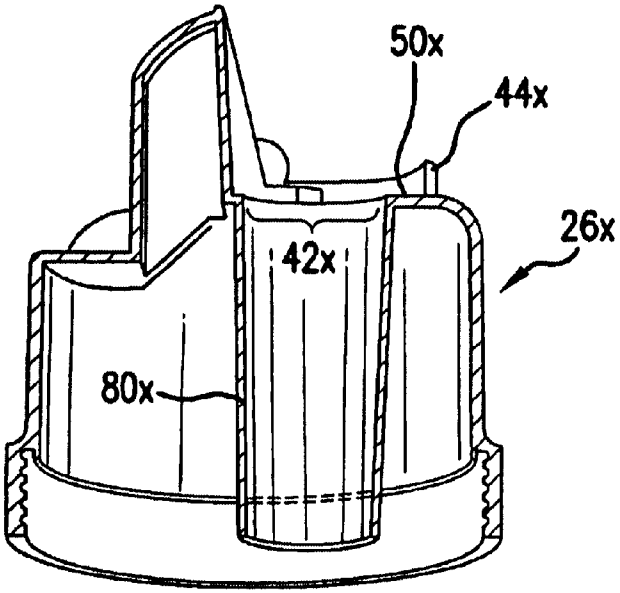
FIG. 14 is a cross-sectional view of the upper body of the container according to another embodiment thereof.

A tube 80 extends from the opening 42 in the top wall 40 into the interior of the upper body 26. The tube 80 functions as a guide for the stopper 54. The tube 80 can have a generally rectangular configuration that is adapted to receive the generally rectangular cross-section of the stopper 54. Even though the tube 80 is illustrated as being rectangular in cross-section, it is possible to provide the tube 80 in any desired configuration. For example, as shown in FIG. 14 and as described in greater detail hereinbelow, the tube 80 can have a generally oval or elongated curved configuration. The tube 80 can extend for any desired length into the interior of the container 20. For example, as shown in FIGS. 3 and 4, the tube 80 can extend for a length that is about the same as the length of the upper body 26, so that the lowermost end 82 of the tube 80 extends to the region where the rims 32 and 36 are located. Alternatively, the tube 80 can extend for a length that is less than the length of the upper body 26, or for a length that is greater than the length of the upper body 26 so that the lowermost end 82 is positioned inside the interior chamber 24 of the lower body 22.

The lower body 22 and the upper body 26 can be made from the same material, or from different materials. Possible materials for the lower body 22 and the upper body 26 can include plastic, acrylic, metal, glass or certain fabrics. The top wall 40, hood 60 and tube 80 can be molded or provided in one piece together with the upper body 26.

Figure 8:
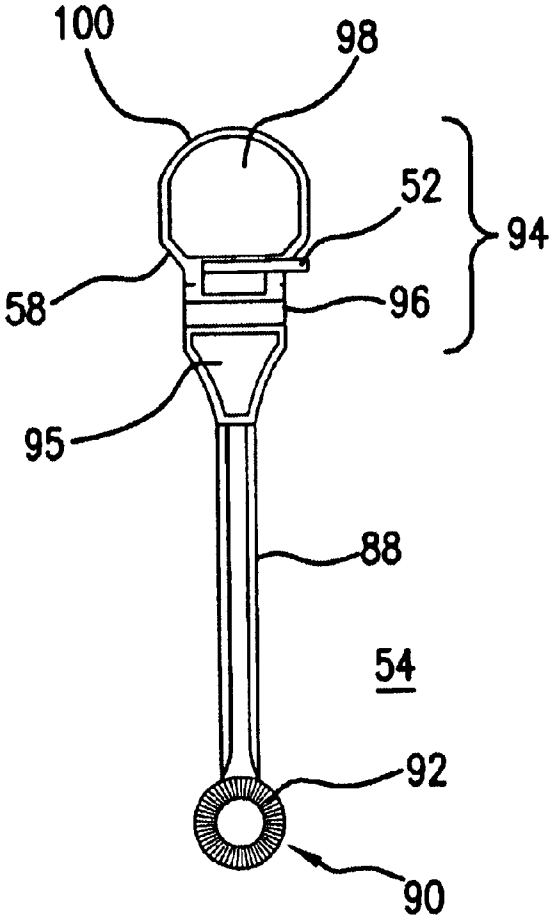
FIG. 8 is a front plan view of a bubble producing toy that may be used with the container of FIGS. 1–4.
Figure 10:
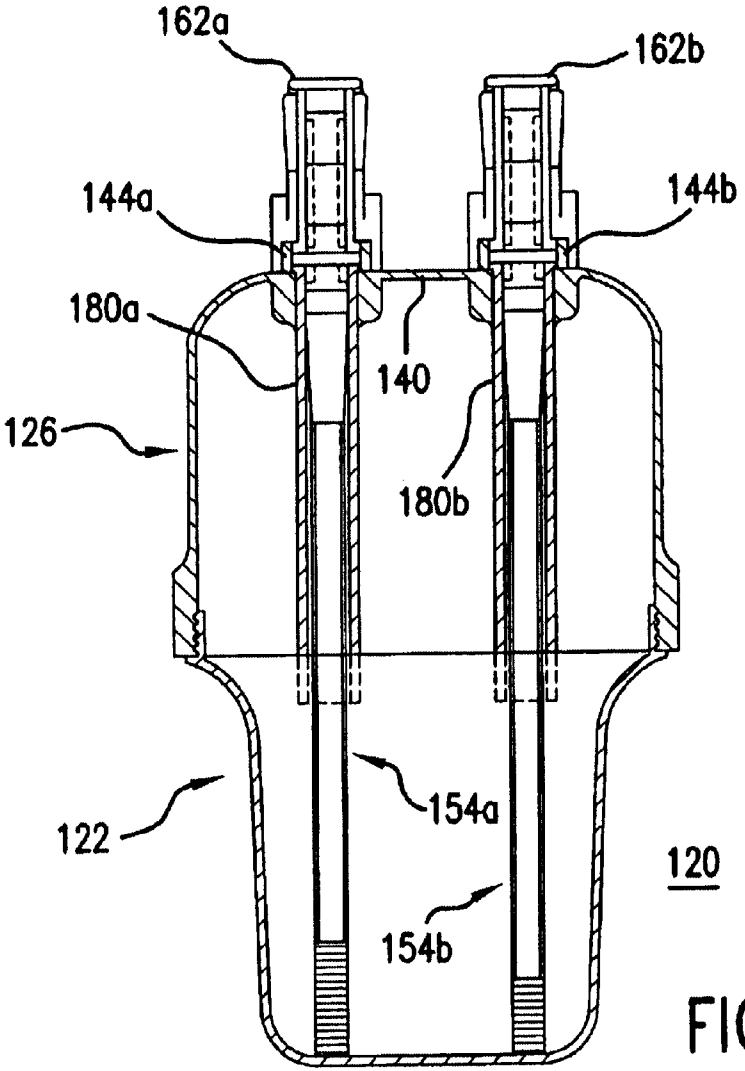
FIG. 10 is a front cross-sectional view of the container of FIG. 9.
Figure 9:
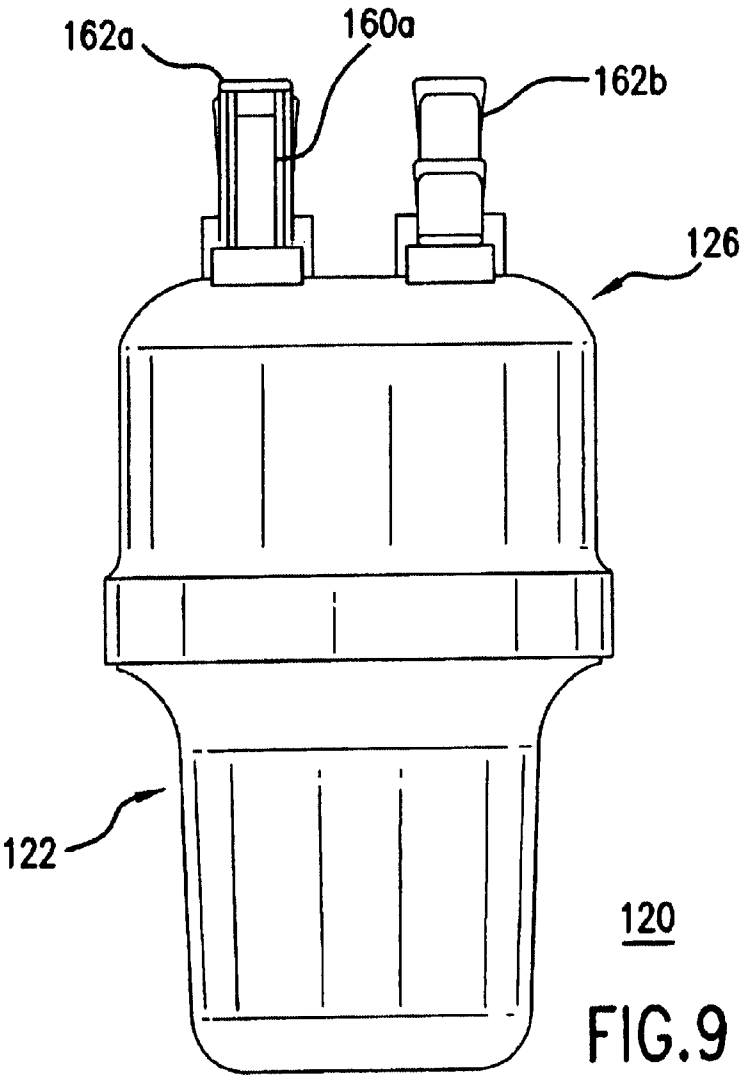
FIG. 9 is a front plan view of a non-spill container according to another embodiment of the present invention.

The stopper 54 as shown in FIGS. 1–7 is a bubble producing toy 54 (also referred to herein as a "wand"), and is illustrated in greater detail in FIG. 8. The wand 54 has a thin shaft 88 having a ring-like loop 90 provided at a first end. The loop 90 has a serratted ring, such that ridges or bumps 92 are provided on the outer surfaces of the loop 90. The ridges 92 function to hold the bubble solution against the loop 90 to form a solution film that is blown to form the bubbles. The loop 90 can have any desired shape. The other (i.e., second) end of the shaft 88 has a support section 94 that includes a shoulder 95, a lining 96, an enlarged gripping handle or blade 98, and the extension 52. Specifically, the shoulder 95 is generally triangular and is provided adjacent the second end of the shaft 88. The lining 96 is provided above the shoulder 95 and functions like a gasket to prevent the liquid stored in the interior chamber 24 from passing therethrough. The lining 96 can be made from rubber, plastic and certain fabrics. The extension 52 is provided above the lining 96, and protrudes outwardly in one or more directions. The handle or blade 98 is positioned above the extension 52, and has an angled lower edge 58 adjacent the extension 52.

Although the bubble producing toy 54 is illustrated as being inserted through the opening 42 to act as a stopper, other stoppers can also be used to seal the opening 42. For example, the stopper can have the same configuration as the bubble producing toy 54 (i.e., including the shaft 88, the shoulder 95, the lining 96, the enlarged gripping handle or blade 98, and the extension 52), but with the loop 90 omitted. With the loop 90 omitted, the shaft 88 can be provided as a hollow tube with the lower end opened, so that the stopper can then be used as a bulb or syringe for drawing medicine stored in the container 20.

In operation, the lower body 22 and upper body 26 are provided separately. Any liquid (e.g., bubble solution) can be filled into the interior chamber 24, and then the upper body 26 connected to the lower body 22 by engaging the threads 34 and 38 of the flared rims 32 and 36, respectively. The lid 62 is now pivoted to the opened position shown in FIGS. 2 and 4. The wand 54 is then inserted through the opening 42 so that the loop 90 and a lower portion of the shaft 88 extend through the tube 80 and into the interior chamber 24 of the lower body 22, with an upper portion of the shaft 88, the shoulder 95 and the lining 96 retained inside the tube 80 (see FIGS. 3 and 4). At this time, the extension 52 will engage the ledge 50, which acts as a stop surface to prevent the wand 54 from being inserted any further into the opening 42. In addition, the angled lower edge 58 will engage the angled inner surface 56 of the well region, which also acts as a stop surface to prevent the wand 54 from being inserted any further into the opening 42. At this time, the provision of the lining 96 inside the tube 80, coupled with the extension 52 engaging and covering the ledge 52 inside the well region, will prevent the liquid inside the container 20 from being leaked or spilled via the tube 80 and the opening 42. The lid 62 can now be pivoted to its closed position shown in FIGS. 1 and 3, with the rounded top wall 70 covering the wand 54, and more particularly, engaging the top edge 100 of the handle or blade 98 to keep the support section 94 securely positioned over the opening 42 as a further safeguard against leakage through the opening 42.

To access the liquid stored inside the container 20, the user merely flips (i.e., pivots) open the lid 62 to the opened position shown in FIGS. 2 and 4, grips the handle 98, and lifts the wand 54. If the liquid is a bubble solution, then the user can insert the wand 54 back through the opening 42 to access more of the bubble solution to create more bubbles. If the liquid is a medicine, the user can insert the medicine stopper 54 back through the opening 42 to access more of the medicine.

FIGS. 9–13 illustrate another container 120 according to the present invention. The container 120 is essentially the same as the container 20, except that the upper body 126 of the container 120 has two openings and two corresponding tubes 180*a* and 180*b*. Each opening is provided with its own ridge 144*a*, 144*b*, hood 160*a*, 160*b* and lid 162*a*, 162*b*. The two tubes 180*a*, 180*b* and their respective openings can be positioned side-by-side from the top wall 140 of the upper body 126. Otherwise, the construction and use of the lower body 122 and the upper body 126 are the same as for the container 20. The elements in FIGS. 9–13 that correspond to the same elements in FIGS. 1–7 are provided with the same numeral designations, except that a "1" has been added before each such element in FIGS. 9–13. For example, the tubes 180*a* and 180*b* in FIGS. 9–13 have the same construction as tube 80 in FIGS. 1–7, and so a "1" was added before the "80".

Figure 13:
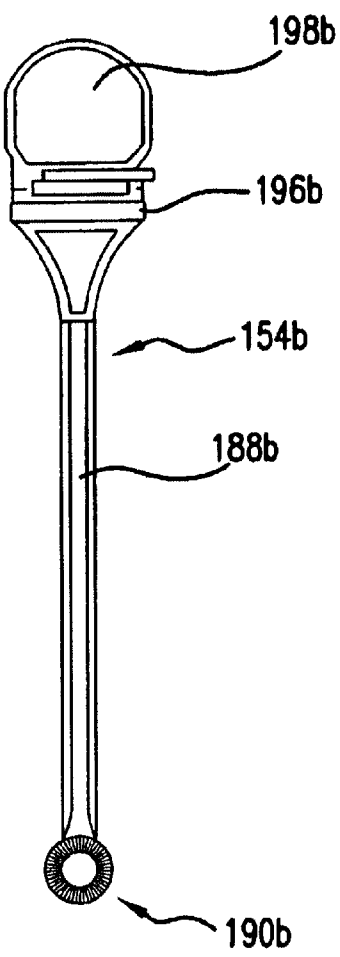
FIGS. 12 and 13 are front plan views of different bubble producing toys that may be used with the container of FIGS. 9–11.
Figure 12:
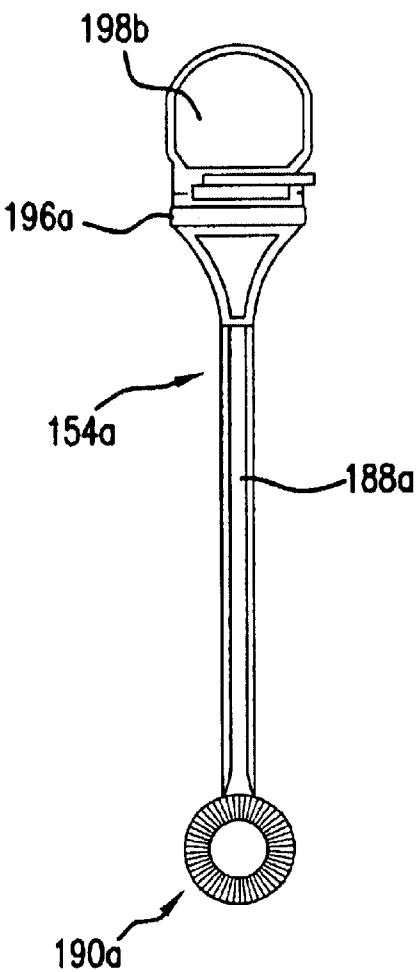
Figure 11:
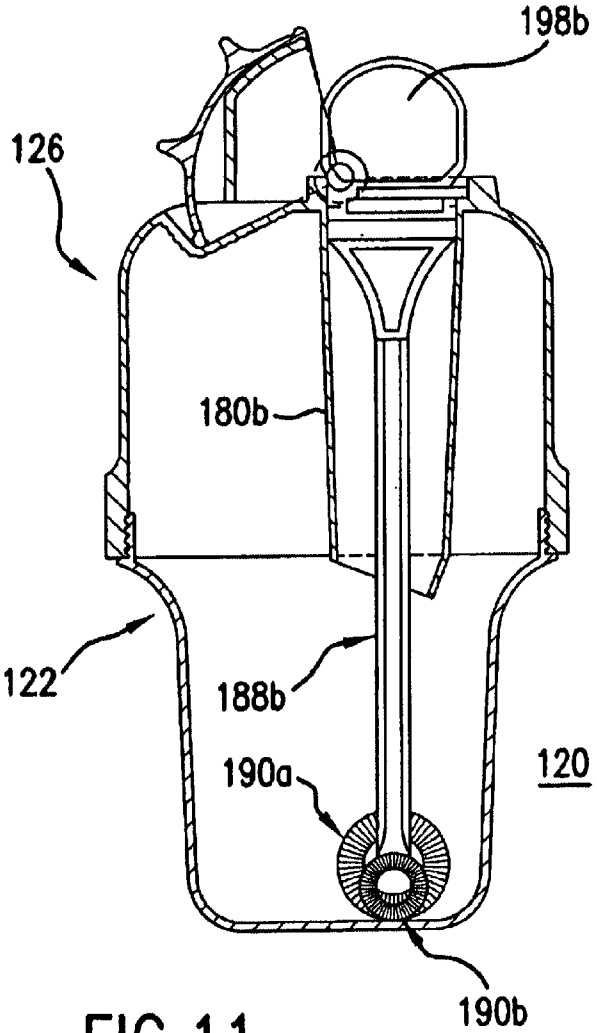
FIG. 11 is a side cross-sectional view of the container of FIG. 9.

The two tubes 180*a*, 180*b* of the container 120 are provided to retain two separate wands 154*a* and 154*b* which are illustrated in FIGS. 12 and 13, respectively. These two wands 154*a* and 154*b* are identical in construction to the wand 54, except that the sizes of the loops 1 90*a* and 1 90*b* are different so that each wand 154*a* and 154*b* produces bubbles having different sizes. As a result, the container 120 provides the user with the option of using different wands 154*a*, 154*b* to create differently-sized bubbles.

Figure 15:
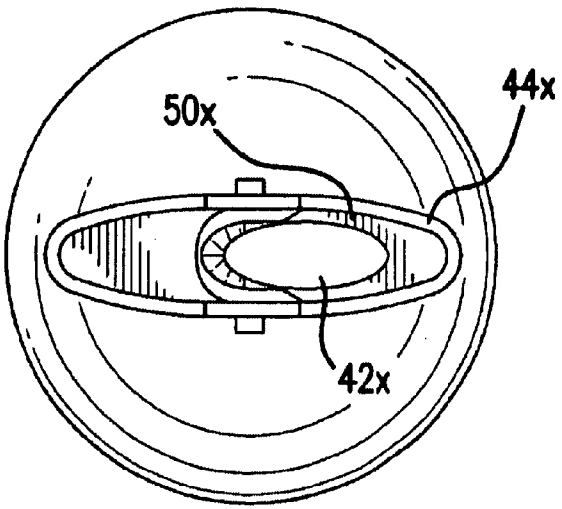
FIG. 15 is a top plan view of the opening of the upper body of FIG. 14 with the lid opened.
Figure 16:
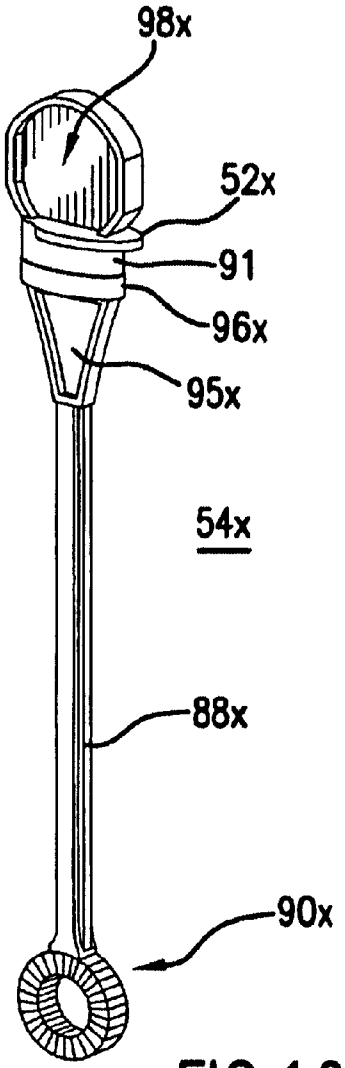
FIG. 16 is a perspective view of a bubble producing toy that illustrates modifications made to the bubble producing toy of FIG. 8.

The configuration of the tubes 80, 180*a*, 180*b* and the openings 42 can be modified from the rectangular configurations illustrated in FIGS. 1–13. Referring to FIGS. 14 and 15, the upper body 26*x* can have a generally curved, circular, oval or elliptical border ridge 44*x*, and a generally curved, circular, oval or elliptical opening 42*x*. The ledge 50*x* is also shown in FIGS. 14 and 15, and can also be curved, circular or elliptical. In addition, the tube 80*x* and its cavity can also have a generally curved, circular, oval or elliptical configuration. As used herein, the terms "curved", "circular", "oval" and "elliptical" all mean that the opening 42*x* and cavity of the tube 80*x* does not have any straight edges. Otherwise, the construction of the upper body 26*x* can be the same as any of the upper bodies 26 and 126 illustrated hereinabove. Similarly, referring to FIG. 16, the stopper 54 in FIG. 8 can also be modified so that the stopper 54*x* now has a generally curved, circular, oval, or elliptical neck 91 positioned below the extension 52*x* to fit inside the similarly configured opening 42*x*. The lining 96*x* can be placed around the neck 91 and assume a similar curved configuration. Otherwise, the loop 90*x*, shaft 88*x*, shoulder 95*x*, and blade 98*x* can be the same as the corresponding elements for the stopper 54 in FIG. 8.

The curved, circular, oval or elliptical opening 42*x* and tube 80*x* has a curvature that provides several benefits. First, it allows the use of a wide variety of stoppers 54 or 54*x*. While a rectangular opening 42 and the rectangular cavity of the tube 80 allows a narrow or slim-profile stopper 54, 54*x* to extend therethrough, the narrow profile of the rectangular opening 42 and cavity cannot accomodate stoppers having a shaft 88 or neck 91 that may have wider or different profiles. Second, the curvature makes it easier and more convenient to insert and remove the stoppers 54, 54*x* because the curvature of the opening 42*x* and tube 80*x* generally increases the width (i.e., minor axis) of the opening 42*x* and tube 80*x* (particularly at the center thereof, making it easier to engage the stopper 54, 54*x* into the opening 42*x*. Third, the curvature allows the stopper 54, 54*x* to be provided with curved engaging edges (i.e., the curved neck 91), thereby reducing sharp edges that may cause injury to the user. For example, rectangular necks 91 would have four sharp edges that can be further sharpened after extended insertion and withdrawal from the tube 80, 80*x*. Fourth, the curvature of the opening 42*x* provides a better seal when cooperating with the neck 91 and lining 96*x* of the stopper 54*x*. This is because it is easier to match engaging curved surfaces (e.g., matching 42*x* with 96*x*) to better seal the tube 80*x* and prevent spillage of the liquid stored therein. In contrast, engaging rectangular and straight surfaces are more difficult to match and do not provide as effective a seal.

Although the present invention has been described in connection with the preferred embodiments, it will be appreciated by those skilled in the art that modifications can be made and alternatives utilized without departing from the spirit and scope of the present invention. For example, the lid 62, 162*a*, 162*b* can be provided in any shape or size as long as it effectively covers the stopper 54, 154*a*, 154*b* and retains the stopper 54, 154*a*, 154*b* securely at the opening 42, 42*x*.

What is claimed is:

1. A bubble solution container, comprising:

a container body having an inner chamber, a bottom wall, a top wall, an opening provided in the top wall, and a tube extending from the opening into the inner chamber to provide communication between the inner chamber and the exterior of the container body, the tube having a curved cross-section, with the tube and the top wall formed in one piece with the container body;

a bubble wand having a shaft that includes a lower end, and a loop that is provided at the lower end of the shaft; and wherein the shaft of the bubble wand has a curved cross-section, and is removably retained inside the opening.

2. The container of claim 1, wherein the container body includes:

a lower body that receives liquid therein and having the bottom wall and an open upper mouth; and an upper body having the top wall and an open lower mouth, the upper body being removably connected to the lower body with the open mouths thereof in communication with each other to form the inner chamber.

3. The container of claim 2, further including a lid pivotably coupled to the top wall and covering the opening.

4. The container of claim 3, further including a hood connected to the top wall and cooperating with the lid to completely cover the opening.

5. The container of claim 4, wherein the lid is pivoted over the hood.

6. The container of claim 3, wherein the lid pivots between a closed position with the lid covering the opening, and an opened position with the opening exposed.

7. The container of claim 1, wherein the opening has a configuration selected from the group consisting of oval, circular and elliptical.

8. The container of claim 1, wherein the wand has an extension that engages the top wall to prevent the wand from being further inserted into the inner chamber.

9. A bubble solution container, comprising:

a container body having an inner chamber, a bottom wall, a top wall, an opening provided in the top wall, and a tube extending from the opening into the inner chamber to provide communication between the inner chamber and the exterior of the container body, the tube positioned offset from the center of the inner chamber, with the tube and the top wall formed in one piece with the container body;

a bubble wand having a shaft that includes a lower end, and a loop that is provided at the lower end of the shaft; and wherein the shaft of the bubble wand is removably retained inside the opening.

10. The container of claim 9, wherein the container body includes:

a lower body that receives liquid therein and having the bottom wall and an open upper mouth; and an upper body having the top wall and an open lower mouth, the upper body being removably connected to the lower body with the open mouths thereof in communication with each other to form the inner chamber.

11. The container of claim 10, further including a lid pivotably coupled to the top wall and covering the opening.

12. The container of claim 11, further including a hood connected to the top wall and cooperating with the lid to completely cover the opening.

13. The container of claim 11, wherein the lid pivots between a closed position with the lid covering the opening, and an opened position with the opening exposed.

14. The container of claim 9, wherein the tube has a curved cross-section.

15. The container of claim 9, wherein the opening is curved.

16. The container of claim 15, wherein the opening has a configuration selected from the group consisting of oval, circular and elliptical.

17. The container of claim 9, wherein the wand has an extension that engages the top wall to prevent the wand from being further inserted into the inner chamber.

18. The container of claim 9, wherein the shaft of the wand has a curved cross-section.

19. A bubble solution container, comprising:

a container body having an inner chamber, a bottom wall, a top wall, an opening provided in the top wall, and a tube extending from the opening into the inner chamber to provide communication between the inner chamber and the exterior of the container body, the tube having a curved cross-section and positioned offset from the center of the inner chamber, the tube and the top wall formed in one piece with the container body;

a bubble wand having a shaft that includes a lower end, and a loop that is provided at the lower end of the shaft; and wherein the shaft of the bubble wand has a curved cross-section, and is removably retained inside the opening and the tube.

* * * * *